US006065525A

United States Patent [19]

Wells

[11] Patent Number: 6,065,525

[45] Date of Patent: May 23, 2000

[54] ROLLUP DOOR ASSEMBLY

[75] Inventor: David M. Wells, Arlington, Tex.

[73] Assignee: Overhead Door Corporation, Dallas, Tex.

[21] Appl. No.: 09/244,648

[22] Filed: Feb. 4, 1999

[51] Int. Cl.[7] ..... A47G 5/02

[52] U.S. Cl. ..... 160/273.1; 160/903

[58] Field of Search ..... 160/133, 270, 160/271, 272, 273.1, 903, 23.1, 25, 31

[56] References Cited

U.S. PATENT DOCUMENTS

| | | | |
|---|---|---|---|
| 3,489,200 | 1/1970 | Recchione | 160/133 |
| 4,219,067 | 8/1980 | Hurst | 160/133 |
| 4,234,033 | 11/1980 | Leivenzon et al. . | |
| 4,601,320 | 7/1986 | Taylor . | |
| 4,921,033 | 5/1990 | Finch et al. . | |
| 4,930,563 | 6/1990 | Finch et al. . | |
| 5,042,556 | 8/1991 | Ruiter | 160/271 X |
| 5,172,744 | 12/1992 | Finch et al. . | |
| 5,284,199 | 2/1994 | Finch et al. . | |
| 5,482,104 | 1/1996 | Lichy . | |
| 5,544,690 | 8/1996 | Magro et al. . | |
| 5,609,196 | 3/1997 | Kraler . | |
| 5,657,805 | 8/1997 | Magro . | |
| 5,839,493 | 11/1998 | Quasius | 160/133 |

*Primary Examiner*—David M. Purol

*Attorney, Agent, or Firm*—Akin, Gump, Strauss, Hauer & Feld, LLP

[57] ABSTRACT

A rollup door assembly including a corrugated flexible sheet closure member secured to a rotatable drum for rolling the closure member onto and off of the drum for opening and closing the door. Opposed channel shaped guide tracks are securable to a wall adjacent an opening to be closed by the door and include elongated wind lock members disposed therein. Elongated polymer rub strips are secured to reentrant end portions of the channel shaped guide tracks for engagement with lateral side edges of the door closure member. Somewhat hook shaped wind lock members are secured to the closure member at the side edges, respectively for engagement with the wind lock members in the guide tracks. Drum support brackets include laterally extending tab members insertable through openings in web portions of the guide tracks for rapid assembly of the drum support brackets to the guide tracks. Closure member bottom edge stop members are mounted on the guide tracks adjacent the upper end thereof and are also provided with spaced apart tab members which extend through openings formed in flanges of the guide tracks for rapidly securing the stop members to the guide tracks.

20 Claims, 3 Drawing Sheets

ROLLUP DOOR ASSEMBLY

FIELD OF THE INVENTION

The present invention pertains to a rollup, sheet type door including opposed channel shaped guide tracks which include elongated wind load resisting lock members engagable with cooperating lock members on the door curtain, opposed support brackets which are connected to the guide tracks by an interlocking tab and slot arrangement, and door stop members also mounted on the guide tracks by an interlocking tab and slot arrangement.

BACKGROUND OF THE INVENTION

Rollup type doors, characterized generally by a flexible curtain which is wound onto and off of a drum for moving the door between open and closed positions, are used in many applications for covering relatively large openings in various types of buildings. One popular application for the general type of door described herein is for so-called mini-warehouses or personal storage facilities wherein a large number of separate storage enclosures are provided for individual use. Typically, these enclosures utilize a relatively large opening at one end of the enclosure which is closeable by a so-called sheet or rollup type door.

The above mentioned application of rollup type doors, as well as certain other applications for rollup doors, require a lightweight structure of relatively low initial cost and requiring minimal assembly or installation procedures. Accordingly, there is an ever-present requirement to provide rollup type doors which are easily fabricated in large quantities at low cost, are adapted for easy erection or installation but which also are reliable and long-lived in use. In this regard there has been a need to improve the support structure for the door curtain including opposed guide tracks which are provided with wind load resisting or locking features cooperable with the door curtain to resist displacement of the curtain under so-called wind loads or other atmospheric pressure differentials.

There has also been a need to provide improved and simplified support structure for the door curtain including such members as the curtain drum support brackets and the door curtain bottom edge stop members. Still further, there has been a need to provide corrugated door panels with structure which will prevent unreleasable nesting of the corrugations in the door rolled up condition, and provide a configuration of door guide tracks which minimize wear on the tracks and on the curtain during opening and closing of the door and minimal noise generated by engagement of the door curtain with the guide tracks during opening and closing movement and while the door is stationary. The above mentioned desiderata in rollup type door assemblies have been met by the present invention.

SUMMARY OF THE INVENTION

The present invention provides an improved rollup or so-called sheet type upward acting door.

In accordance with one aspect of the present invention a rollup door assembly is provided with an improved arrangement of door guide tracks which cooperate with the flexible door sheet or curtain to support the door in the closed position to prevent displacement of the door curtain due to wind loads or other atmospheric pressure differentials, to minimize wear on the door curtain and minimize noise generated by movement of the door curtain under various conditions. The opposed guide tracks comprise channel-shaped members with reentrant flange portions forming a slot for receiving the side edges of the door curtain. Cooperating members mounted in the guide tracks and on the door curtain prevent displacement of the side edges of the curtain from the guide tracks. Elongated snap on and off nonmetallic rub strips are connected to the guide track reentrant flange portions for engagement with the door sheet or curtain to minimize wear and tear on both the door curtain and the guide tracks, to reduce noise during operation and to provide a seal between the door curtain and its support structure.

In accordance with another aspect of the invention the door curtain is provided with spaced apart flexible anti-nesting strips to minimize interference of the corrugated door curtain with itself in the rolled up condition.

In accordance with another aspect of the present invention opposed drum support brackets are configured to be quickly and securely assembled to the curtain guide tracks by cooperating tabs formed on the brackets and slots formed in the guide tracks.

In accordance with yet a further aspect of the invention opposed door bottom edge stop bracket members are provided for connection to the opposed guide tracks to limit the opening movement of the door curtain. The stop members are provided with a mounting and support tab configuration which facilitates quick assembly of the stop members to the guide tracks, respectively.

Those skilled in the art will further appreciate the above-mentioned features and advantages of the rollup door assembly of the present invention together with other important aspects thereof upon reading the detailed description which follows in conjunction with the drawings.

DETAILED DESCRIPTION OF A PREFERRED EMBODIMENT

Figure 1:
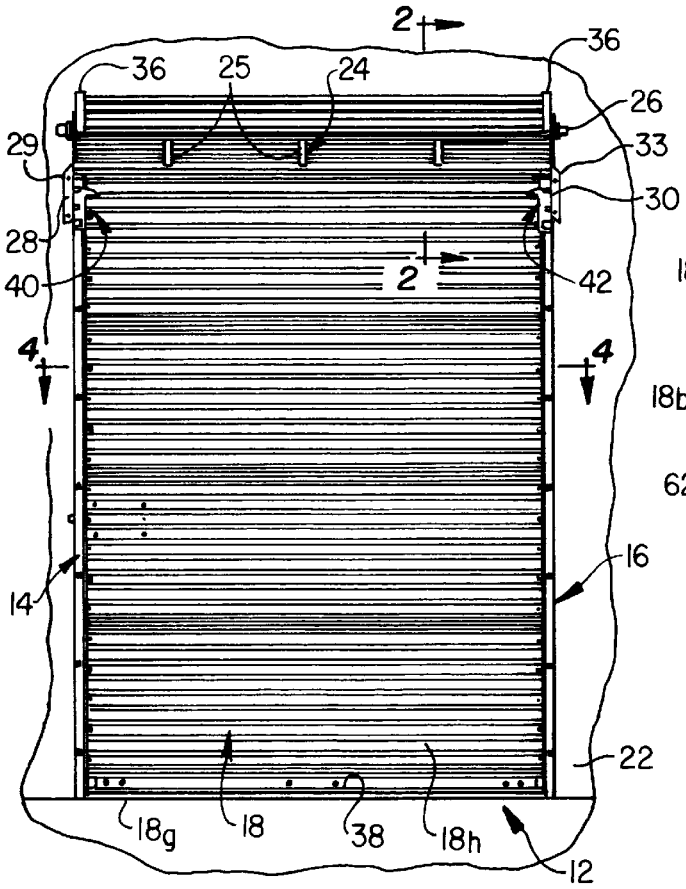
FIG. 1 is a front elevation of a rollup or sheet type door assembly in accordance with the present invention.

In the description which follows like parts are marked throughout the specification and drawing with the same reference numerals, respectively. The drawing figures are not necessarily to scale and certain features may be shown in schematic or somewhat generalized form in the interest of clarity and conciseness.

Referring to FIG. 1, there is illustrated a rollup door assembly in accordance with the invention and generally designated by the numeral 12. The door assembly 12 is characterized by opposed elongated channel shaped guide tracks 14 and 16, see FIG. 4 also, which are operable to guide a flexible corrugated metal or plastic door curtain 18 for movement between open and closed positions to cover an opening 20, FIG. 4, in a wall 22, FIGS. 1 and 4. The curtain 18 is adapted to be rolled up on a drum 24 supported for rotation on a generally horizontally extending shaft 26, FIGS. 1 and 2, which is supported on opposed support brackets 28 and 30, FIG. 1. The brackets 28 and 30 are adapted to be connected to the respective guide tracks 14 and 16 by a connector or coupling arrangement to be described in further detail herein.

Figure 2:
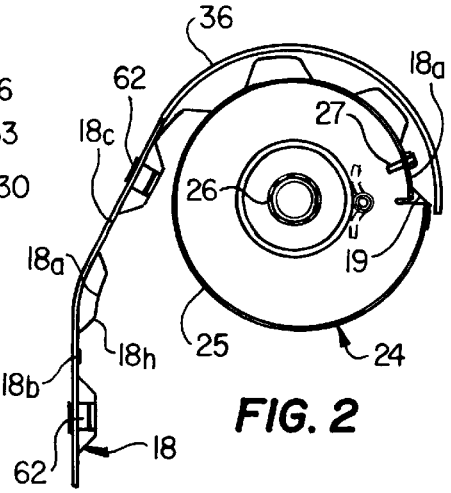
FIG. 2 is a detail section view taken generally from the line 2—2 of FIG. 1.

Referring to FIG. 2, the drum 24 is made up of plural spaced apart wheels 25 on which the corrugated curtain 18 is windable. The curtain 18 may be made up of one or more panels of corrugated metal or plastic sheet and is configured with somewhat zigzag corrugations 18*a* and 18*b*, as shown in FIG. 2. The upper end 19 of the curtain 18 is attached to the drum wheels 25 by suitable fastener means 27, FIG. 2. The so-called outer side 18*c* of the curtain 18 is provide with two spaced apart elongated flexible separator strips, see FIG. 1 also, which are secured to the curtain 18 along opposite lateral sides 18*e* and 18*f*, see FIG. 4 also. The flexible separator strips 36 are suitably secured to the curtain 18 by spaced apart fasteners, not shown, or are otherwise secured to the curtain by suitable means. The flexible separator strips 36 are operable to prevent the corrugations 18*a* and 18*b* from deep nesting with other corrugations 18*a* and 18*b*, respectively, as the curtain 18 is wound onto the drum 24, in a manner which would prevent separation as the curtain 18 is unwound from the drum.

Referring again to FIG. 1, the curtain 18 is provided with a transverse or horizontally extending bottom bar member 38 suitably secured to the lower edge 18*g* of the curtain at the inner side 18*h* of the curtain. The bottom bar 38 is preferably an angle shaped part having a lateral edge which projects away from the plane of the curtain 18 in the closed position thereof and is engagable by opposed stop members or brackets 40 and 42, FIG. 1, to limit the opening movement of the curtain 18. The stop members 40 and 42 are suitably secured to the guide tracks 14 and 16 by an arrangement which will be described in further detail herein with regard to the manner in which the stop bracket 42 is secured to the guide track 16, by way of example.

Figure 4:
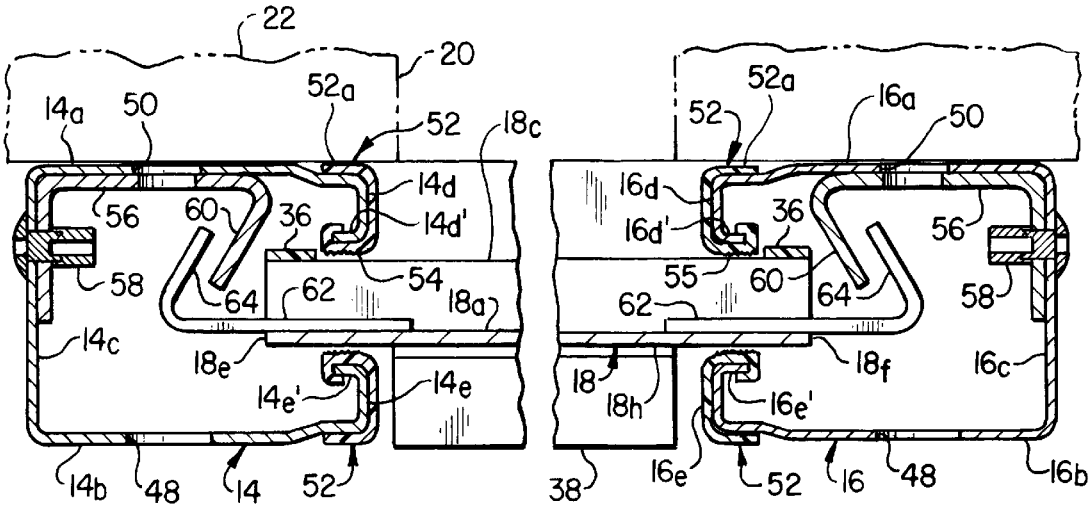
FIG. 4 is transverse section view taken generally along the line 4—4 of FIG. 1.

Referring now to FIG. 4, the guide track 14 is a channel shaped member having opposed parallel side flanges 14*a* and 14*b* and a center web 14*c* integral therewith. Suitable spaced apart clearance openings 48, one shown in FIG. 4, are provided in the flange 14*b* to provide clearance for inserting a fastener through an opening 50 in the opposite flange 14*a* and to allow for a tool to be inserted for driving the fastener to secure the guide track 14 to the wall 22. The flanges 14*a* and 14*b* are provided with reentrant and laterally displaced end portions 14*d* and 14*e* which are parallel and coplanar with each other and also parallel with the web 14*c*. Flange portions 14*d* and 14*e* terminate, respectively, at inturned edges 14*d*' and 14*e*' parallel to flanges 14*a* and 14*b*. Elongated molded polymer wear or rub strips 52 are snap fittable over the reentrant edges 14*d* and 14*e*, as shown in FIG. 4, and define a slot 54 extending vertically substantially the entire length of the channel portion of the guide track 14.

As further shown in FIG. 4, an elongated somewhat channel shaped wind lock member 56 is disposed in the guide track 14 and is suitably secured to the web 14*c* at spaced apart points by suitable fastener means such as rivets 58, one shown. The wind lock member 56 includes a flange 60 extending at an acute angle to and toward the web 14*c* and engagable with suitable angle or hook-shaped wind lock members 62 which are secured to lateral side edge 18*e* of the curtain 18 at spaced apart points, see for example in FIG. 2. The wind lock members 62 each include a distal flange or hook portion 64 normally spaced from the flange 60 but engageable with flange 60 and slidable relative to the flange 60 as the curtain 18 moves longitudinally through the guide tracks 14 and 16. However, lateral displacement of the curtain 18 out of the slot 54 is prevented under wind loads or other atmospheric pressure differential conditions which may exist across the curtain 18. In this regard if, under severe wind loads or other forces, the hook members 62 do not engage the flange 60 the hook members will likely engage the flange ends 14*d* and/or 16*d* to prevent displacement of the curtain 18 from the guide tracks 14 and 16. The wind lock members 62 are suitably secured to the curtain 18 at corrugations 18*a*, for example, by suitable fastener means, not shown.

Referring further to FIG. 4, the guide track 16 is basically a mirror image of guide track 14 and is characterized by parallel flanges 16*a*, 16*b* and a center web 16*c* integrally joined therewith. The flanges 16*a* and 16*b* include respective reentrant end portions 16*d* and 16*e* and distal edges 16*d*' and 16*e*' delimiting a slot 55 through which the opposite lateral side edge 18*f* of the door curtain 18 extends, as shown. Respective snap on polymer rub strips 52 are secured on the flange end portions 16*d* and 16*e*, as shown. Spaced apart wind lock members 62 cooperate with an elongated wind lock member 56 secured within the guide track 16 in the same manner that the other wind lock member 56 is secured within the guide track 14.

Those skilled in the art will appreciate that the wind lock members 62 are not required in some applications of the door 12, particularly if pressure differentials will not be incurred across the plane of the door. The spacing of the wind lock members 62 may vary, depending on the application of the door. For example, in very high wind load conditions a wind lock member 62 may be secured to each corrugation 18*a* whereas in an anticipated low wind load condition the wind lock members 62 may be secured to every other corrugation 18*a*, every fourth corrugation or a suitable spacing, as desired. However, the elongated channel shaped wind lock members 56 which cooperate with the spaced apart wind lock members 62 advantageously secure the side edges of the door curtain 18 within the guide tracks 14 and 16 to provide a secure closure across the opening 20.

Figure 3:
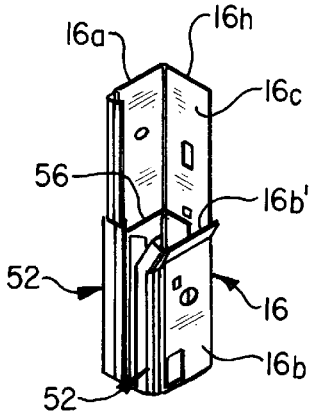
FIG. 3 is a detail perspective view of the upper end of the right-hand guide track of the door assembly shown in FIG. 1.

Referring briefly to FIG. 3, as shown by way of example, the upper end 16*h* of the guide track 16 is illustrated to show that the flange 16*a* extends further than the flange 16*b* and the flange 16*b* is bent outwardly at an acute angle at distal end 16*b*' away from the plane of the flange 16*a* to provide a guide for the curtain 18 as it moves on and off of the drum 24. The guide track 14 is similarly configured and, as mentioned previously, is essentially a mirror image of the guide track 16.

Figure 5:
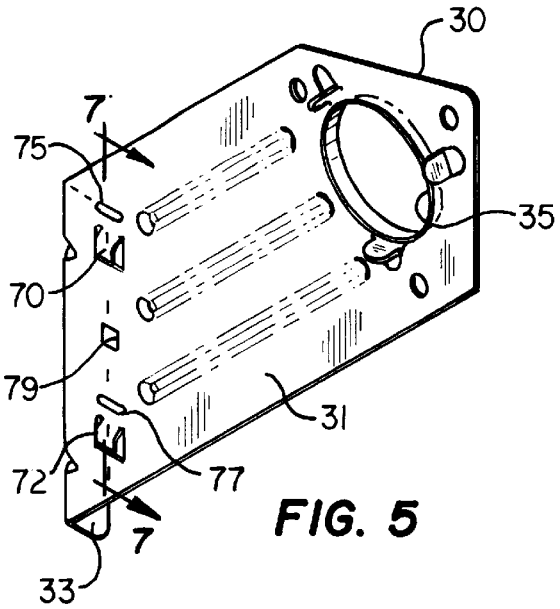
FIG. 5 is a perspective view of one of the drum support brackets for the door assembly of FIG. 1.

Referring now to FIG. 5, there is further illustrated the drum support bracket 30. The bracket 28 is a mirror image of the bracket 30. The bracket 30 includes a generally planar plate portion 31 and a transverse flange portion 33 formed integral with the plate portion and extending at a substantially right angle thereto. A flanged bore 35 is formed in the plate portion 31 for receiving a suitable bearing, not shown, for supporting one end of the drum 24. The plate portion 31 of the bracket 30 is provided with spaced apart downwardly extending mounting tabs 70 and 72, see FIG. 7 also, which may be formed by a coining or punching operation to displace material of the plate portion 31 and to leave generally rectangular openings 71 and 73, respectively, in the plate portion 31. Spaced apart projections or detent portions 75 and 77 are formed in the plate portion 31 above the tabs 70 and 72, respectively. A rectangular fastener receiving bore 79 is formed in the plate portion 31 between the tabs 70 and 72.

Figure 6:
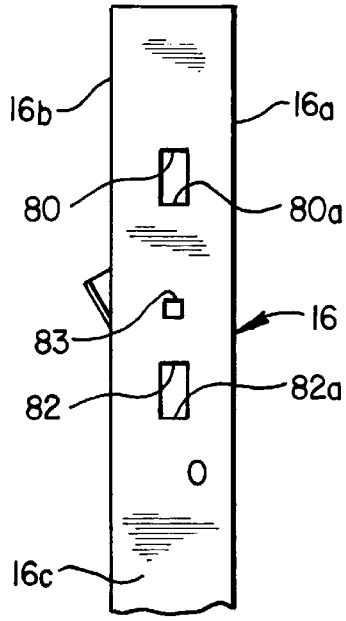
FIG. 6 is a detail side elevation of the upper end of the right-hand guide track.

Referring to FIG. 6, the upper portion of the guide track 16 is illustrated in side elevation showing elongated rectangular openings 80 and 82 formed in the track web 16*c*. A rectangular fastener receiving bore 83 is formed in the web 16*c* between the openings 80 and 82.

Figure 7:
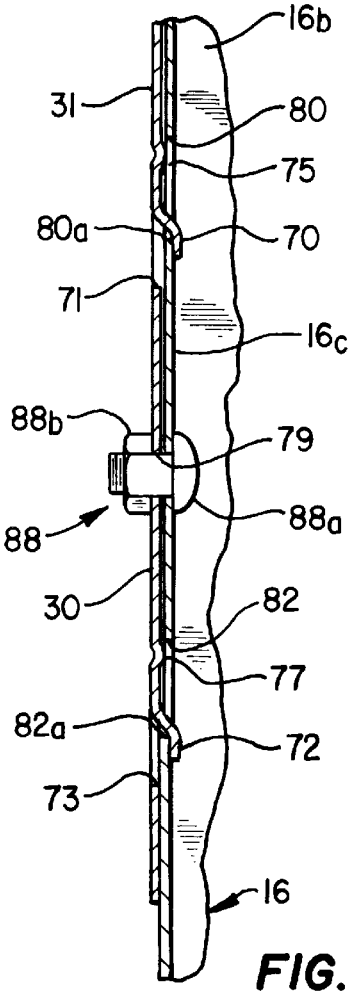
FIG. 7 is a detail section view taken along the line 7—7 of FIG. 5 showing the bracket of FIG. 5 assembled to the guide track shown in FIGS. 3 and 6.

FIG. 7 shows the bracket 30 secured to the guide track 16 in an improved manner. The spacing of the openings 80 and 82 is such that the bracket 30 may be mounted on the web 16*c* by aligning the tabs 70 and 72 with the openings, and moving the bracket 30 downwardly with the tabs 70 and 72 projecting trough the openings 80 and 82 until the tabs register with the respective lower edges 80*a* and 82*a* of the openings, whereupon the openings or bores 79 and 83 are aligned so that a suitable mechanical fastener assembly 88, comprising a carriage bolt 88*a* and a nut 88*b*, for example, may be assembled, as shown. When the bracket 30 is assembled to the guide track 16 the tabs 70 and 72 are inserted in the openings 80 and 82 and the bracket is moved downwardly until the detents 75 and 77 also register with the respective upper edges of the respective openings 80 and 82 opposite the edges 80*a* and 82*a*. In this way the bracket 30 may be retained in engagement with the guide track 16 without use of the bolt assembly 88. However, for added security the bolt assembly 88 may be used to firmly secure the bracket 30 to the guide track 16.

The bracket 28 is secured to the guide track 14 in the same manner as described above for the arrangement of the bracket 30 and the guide track 16. The bracket 28 is preferably an exact mirror image of the bracket 30, and the guide track 14 is preferably an exact mirror image of the guide track 16.

Figure 8:
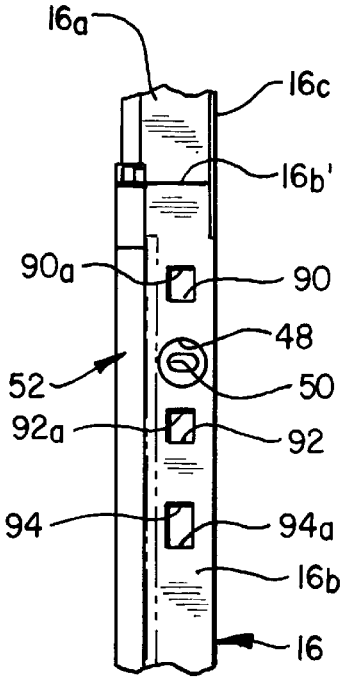
FIG. 8 is a detail front elevation showing a portion of the inner side flange of the guide track shown in FIGS. 3 and 6.

Referring to FIG. 8, a portion of the guide track 16 is shown wherein generally rectangular openings 90, 92, and 94 are formed in the flange 16*b* and spaced apart below the curtain entry and exit guide flange portion 16*b*′.

Figure 9:
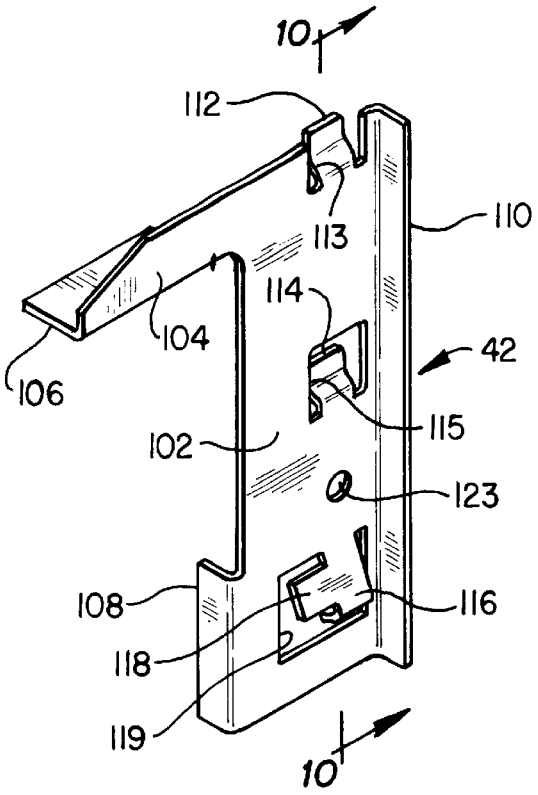
FIG. 9 is a perspective view of a door bottom edge stop bracket in accordance with the present invention.
Figure 10:
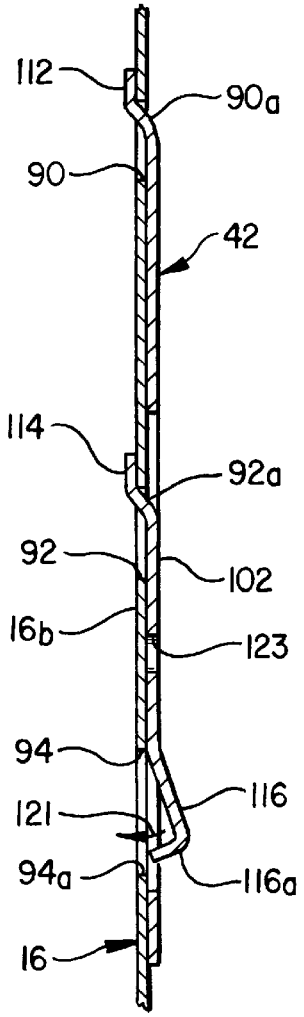
FIG. 10 is a detail section view taken generally along the line 10—10 of FIG. 9 and showing the bracket of FIG. 9 assembled to the guide track at the area shown in FIG. 8.

Referring also to FIGS. 9 and 10, one of the door bottom edge stop members is illustrated by way of example. Referring to FIG. 9, the stop member 42 preferably comprises a formed metal plate having a substantially planar main body part 102 and a laterally projecting stop part 104 including an inturned flange portion 106 engagable with the bottom bar member 38 when the curtain 18 is moved to a fully open position. The stop member 42 is further provided with a locating flange portion 108 which projects normal to the body part 102 in one direction and a stiffening flange 110 which projects from the plane of the body part 102 in the opposite direction. The stop member 42 is further provided with upwardly projecting laterally displaced tabs 112 and 114 which are displaced from the plane of the body part 102 and are preferably formed by a punch operation to displace the metal of the tabs 112 and 114 to provide openings 113 and 115 in the body part 102. A downwardly extending tab 116 is also formed on the body part 102, projects away from the plane of the body part and includes a laterally projecting stop finger 118. The tab 116, 118 is also preferably formed by a punch operation which results in material being displaced and removed to leave a generally rectangular opening 119 in the body part 102.

Referring now to FIG. 10, the section view of FIG. 10 is taken with the stop member 42 mounted on the flange 16*b* of the guide track 16 with the body part 102 extending substantially coplanar with the flange 16*b* and with the tab 112 extending through the opening 90. In like manner the tab 114 extends through the opening 92. When the stop member 42 is assembled to the guide track 16 the tabs 112 and 114 are aligned with openings 90 and 92, the stop member 42 is moved to a position wherein the body part 102 is contiguous with flange 16*b* and the stop member 42 is then moved upwardly until the tabs 112 and 114 engage the flange 16*b* at opening edges 90*a* and 92*a*, respectively, in the position shown in FIG. 10.

At this time the tab 116 may be bent toward the flange 16*b* in the direction of arrow 121 to allow the laterally extending distal end 116*a* of the tab to project through the opening 94. Movement of the tab 116 is limited by engagement of the stop finger 118 with the flange 16*b* adjacent the opening 94. The tab 116 is plastically deformed into the position just described, in which position, the tab distal end 116*a* is engagable with the flange 16*b* at the edge 94*a* of opening 94 to prevent disconnection of the stop member 42 from the guide track 16. Additional securement of the stop member 42 to the guide track 16 may be obtained by inserting a self drilling and tapping fastener, not shown, through an opening 123 in the body part 102 and engageable with the flange 16*b*. The stop member 40 is secured to the guide track 14 in substantially the same manner and the stop member 40 is of substantially the same configuration as the stop member 42 but is a mirror image thereof.

Those skilled in the art will recognize from the foregoing description, and the drawings, that the door 12 enjoys several improvements in the art of rollup doors including the ease with which the door may be erected over an opening, such as the opening 20 in a vertical wall 22.

In one preferred method of erecting the door 12, the guide tracks 14 and 16 are placed in parallel relationship on a floor or surface adjacent the opening 20 and generally aligned with the opening in such a way that, as the guide tracks are erected, they may assume their working positions when attached to the wall 22. With the guide tracks placed on a floor or surface as described, the drum support brackets 28 and 30 are assembled to the respective tracks 14 and 16 as previously described and with the drum 24 suitably mounted on the drum support brackets with the closure curtain 18 in a rolled condition. The entire assembly of the guide tracks 14 and 16, the brackets 28 and 30 and the drum 24 may then be erected and placed in the working position of the door 12 shown in the drawings. The guide tracks 14 and 16 may then be suitably secured to the wall 22. The closure 18 is then fed down through the slots 54 and 55 in the opposed guide tracks toward the closed position or at least sufficiently such that the bottom edge stop members 40 and 42 may be mounted on the guide tracks 14 and 16 and secured in their working positions to prevent the door bottom edge stop member 38 from rolling onto the drum 24.

Alternatively, the guide tracks 14 and 16, in assembly with the wear or rub strips 52 and the wind lock members 56 may be secured to the wall 22 in a predetermined position by suitable fasteners, not shown, extending through the openings 50 and accessible through the openings 48 in their respective guide track flanges. The brackets 28 and 30 are both provided with laterally extending flanges, such as the flange 33 for the bracket 30, which flanges are dimensioned to be essentially contiguous with the wall 22 when the brackets have been assembled to the guide tracks. The flanges 29 and 33, FIG. 1, of the brackets 28 and 30 may be secured to the wall 22 by suitable fasteners to reinforce the door structure.

The drum 24 is assembled to the brackets 28 and 30 before they are secured to the guide tracks 14 and 16 and with the curtain 18 wound thereon. The curtain 18 may then be fed down through the slots 54 and 55 in the guide tracks 14 and 16 and moved to the closed position of the door. The stop members 40 and 42 may then be snapped into their working positions on the tracks 14 and 16. Accordingly, erection of the door 12 is easily facilitated, generally as described above. The tabs on the drum brackets and stop members and the corresponding slots in the guide tracks may be reversed as to which members include which feature, although the preferred arrangement of the tabs and slots is as described hereinbefore.

Figure 11:
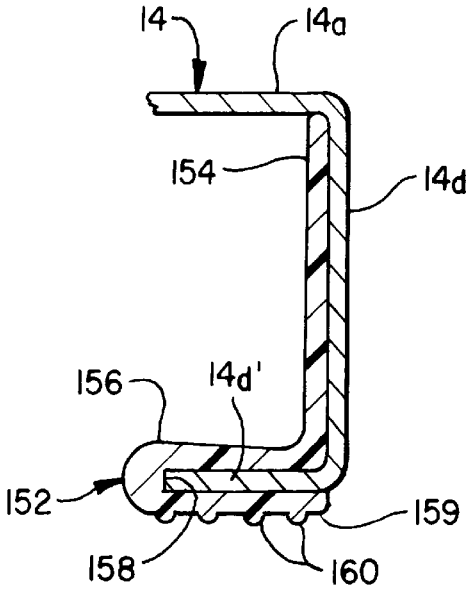
FIG. 11 is a detail section view of an alternate embodiment of a rub strip shown mounted on one of the guide track flanges.

Referring now to FIG. 11, an alternate embodiment of a door closure member rub strip is illustrated and generally designated by the numeral 152. The rub strip 152 is shown, by way of example, mounted on reentrant flange end 14*d* of guide track 14. A rub strip 152 may be mounted on each reentrant end of each flange of the respective guide tracks 14 and 16. The rub strip 152 is characterized by an elongated leg 154 adapted to be disposed between the flange 14*a* and the inturned flange distal edge 14*d*' and is formed integral with a second leg 156 extending substantially normal to the leg 154. The leg 156 is of a greater thickness than the leg 154 and is formed with an elongated open ended slot 158 for receiving the inturned flange distal edge 14*d*' therein. The leg 156 is provided with a door curtain engaging surface 159 from which project a plurality of elongated spaced apart parallel ribs 160 which are adapted to engage the curtain 18 to form low friction bearing surfaces, as needed. The rub strip 152 is advantageous in that it requires less material than the rub strips 52 although the rub strips 52, see FIG. 4, are provided with a leg 52*a* which may serve as a gasket or seal member when mounted on the flange ends 14*d* and 16*d* and trapped between the flanges 14*a* or 16*a* and the wall against which the guide tracks are mounted. The rub strip 152 may also be molded or extruded of a suitable polyethylene composition.

The construction of the door 12 and its component parts may be carried out using conventional engineering materials normally used for construction of rollup doors and the like. A preferred material for the rub or wear strips 52 is a molded or extruded polymer, such as polyethylene, and a preferred material for the anti-nesting strips 36 is a low density polyethylene.

Although a preferred embodiment of a rollup door has been described in detail herein, those skilled in the art will also appreciate that various substitutions and modifications may be made to the door and its components without departing from the scope and spirit of the appended claims.

What is claimed is:

1. A rollup door comprising:

a flexible closure member having a bottom edge and opposed generally parallel side edges;

a drum member for rolling said closure member thereon and unrolling said closure member therefrom to open and close said door;

a pair of opposed elongated guide tracks adapted to be secured to a wall adjacent an opening to be closed by said door, said guide tracks comprising opposed generally channel shaped members including opposed flanges with respective reentrant ends defining elongated slots facing each other for receiving said side edges of said closure member;

opposed drum support brackets for supporting said drum for rotation to roll and unroll said closure member; and spaced apart wind lock members mounted on said closure member and extending from said side edges of said closure member, respectively, each of said wind lock members including a hook portion that extends at an acute angle with respect to said closure member, said hook portion being engageable with cooperating longitudinally extending wind lock flanges disposed on said guide tracks for retaining said closure member in said slots when said closure member is in a door closed position.

2. The rollup door set forth in claim 1 wherein:

said closure member comprises at least one corrugated panel having laterally extending corrugations formed thereon and said wind lock members are secured to said at least one panel at spaced apart ones of said corrugations, respectively.

3. The rollup door set forth in claim 1 wherein:

said wind lock flanges on said guide tracks comprise elongated members having opposed flange portions extending substantially coextensive with said slots in said guide tracks and substantially parallel to and engageable with said hook portions of said wind lock members on said closure member to thereby prevent displacement of said closure member from said guide tracks.

4. The rollup door set forth in claim 2 including:

a continuous, flexible anti-nesting strip extending along an outer side of said closure member and bridging said corrugations to minimize nesting of said corrugations when said closure member is rolled on said drum.

5. The rollup door set forth in claim 3 wherein:

said guide tracks include, respectively, a web interconnecting said track flanges, and said reentrant ends delimiting said slots include inturned distal edges, respectively, said hook portion of said wind lock members being engageable with said inturned distal edges when forces on the closure member prevent mutual engagement of the hook portions and flange portions to thereby prevent displacement of said closure member from said guide tracks.

6. The rollup door set forth in claim 5 including:

elongated closure member rub strips mounted on said reentrant ends of said track flanges for engagement with said closure member, respectively.

7. The rollup door set forth in claim 6 wherein:

said rub strips each include an elongated angle-shaped member having a first leg including an elongated slot formed therein for receiving one of said inturned distal edges of said reentrant end of one of said track flanges, respectively, and a second leg engageable with said reentrant end of said one track flange between said distal edge and said one track flange.

8. The rollup door set forth in claim 1 wherein:

said drum support brackets are mounted on said guide tracks, respectively by cooperating tabs and slots formed on said brackets and said guide tracks and wherein said drum support brackets may be secured to said guide tracks by moving said tabs into said slots and sliding said brackets with respect to said guide tracks to a position wherein said drum support brackets and said guide tracks are locked in engagement with each other.

9. The rollup door set forth in claim 8 wherein:

each of said drum support brackets and said guide tracks includes fastener receiving bores formed therein for receiving a fastener assembly to secure said drum support brackets to said guide tracks, respectively.

10. The rollup door set forth in claim 8 wherein:

said drum support brackets include projections formed thereon and registrable with said slots to retain said tabs in said slots and engaged with said guide tracks.

11. The rollup door set forth in claim 1 wherein:

said closure member includes a bottom edge member extending along said bottom edge and said door includes opposed stop members engageable with said bottom edge member of said closure member to limit the open position of said closure member rolled on said drum.

12. The rollup door set forth in claim 11 wherein:

said stop members are mounted on said guide tracks, respectively.

13. The rollup door set forth in claim 12 wherein:

said stop members each include a body part and a stop portion secured to said body part, said body part includes a plurality of spaced apart tabs formed thereon and said guide tracks include openings formed therein and spaced a predetermined distance from each other corresponding to the spacing to said tabs on said stop members, whereby said stop members may be secured to said guide tracks, respectively, by inserting said tabs in said openings and sliding said stop members in a predetermined direction with respect to said guide tracks.

14. The rollup door set forth in claim 13 wherein:

said stop members each include a third tab cooperating with a third opening formed in said guide track, said third tab being bendable to a position to engage said guide track to prevent disengagement of said stop member from said guide track.

15. A rollup door comprising:

a flexible closure member having a bottom edge and opposed generally parallel side edges;

a drum member for rolling said closure member thereon and unrolling said closure member therefrom to open and close said door;

a pair of opposed elongated guide tracks adapted to be secured to a wall adjacent an opening to be closed by said door, said guide tracks comprising opposed generally channel shaped members having elongated slots facing each other for receiving said side edges of said closure member; and a pair of opposed drum support brackets for supporting said drum for rotation to roll and unroll said closure member, said drum support brackets are mounted directly on said guide tracks, respectively, by cooperating tabs and slots formed on said drum support brackets and said guide tracks and wherein said drum support brackets may be secured to said guide tracks by moving said tabs into said slots and sliding said drum support brackets with respect to said guide tracks to a position wherein said drum support brackets and said guide tracks are locked in engagement with each other.

16. The rollup door set forth in claim 15 wherein:

each of said drum support brackets and said guide tracks includes fastener receiving bores formed therein for receiving a fastener assembly to secure said drum support brackets to said guide tracks.

17. The rollup door set forth in claim 15 wherein:

said closure member includes a bottom edge member extending along said bottom edge and said door includes opposed stop members mounted on guide tracks and engageable with said bottom edge member of said closure member to limit the open position of said closure member.

18. The rollup door set forth in claim 17 wherein:

said stop members each include a body part and a stop portion secured to said body part, said body part includes a plurality of spaced apart tabs formed thereon and said guide tracks each include openings formed therein and spaced a predetermined distance from each other corresponding to the spacing of said tabs on said stop members whereby said stop members may be secured to said guide tracks by inserting said tabs in said openings and sliding said stop members in a predetermined direction with respect to said guide tracks, respectively.

19. The rollup door set forth in claim 18 wherein:

each of said stop members includes a third tab cooperating with a third opening formed in said guide track, said third tab being bendable to a position to engage said guide track to prevent disengagement of said stop member from said guide track.

20. A rollup door comprising:

a flexible closure member having a bottom edge and opposed generally parallel side edges;

a drum member for rolling said closure member thereon and unrolling said closure member therefrom to open and close said door;

a pair of opposed elongated guide tracks adapted to be secured to a wall adjacent an opening to be closed by said door, said guide tracks comprising opposed generally channel shaped members having elongated slots facing each other for receiving said side edges of said closure member;

a pair of opposed drum support brackets for supporting said drum for rotation to roll and unroll said closure member; and opposed stop members mounted on said guide tracks and engageable with said bottom edge of said closure member to limit the open position of said closure member, at least one of said stop members includes a body part and a stop portion secured to said body part, said body part and said guide track including a plurality of spaced apart tabs formed on one of said body part and said guide track, and the other of said body part and said guide track includes openings formed therein and spaced a predetermined distance from each other and corresponding to the spacing of said tabs, one of said one stop member and said guide track includes a third tab cooperating with a third opening formed in the other of said stop member and said guide track, whereby said one stop member may be secured to said one guide track by inserting said tabs in said openings and sliding said one stop member in a predetermined direction with respect to said one guide track, said third tab being bendable to a position to engage said one of said stop member and said guide track to prevent disengagement of said stop member from said guide track.

* * * * *